US005722021A

United States Patent [19]

Iwao

[11] Patent Number: 5,722,021

[45] Date of Patent: Feb. 24, 1998

[54] DEVELOPING DEVICE FOR IMAGE FORMING APPARATUS HAVING A LAYER THICKNESS LIMITING MEMBER

[75] Inventor: Naoto Iwao, Nagoya, Japan

[73] Assignee: Brother Kogyo Kabushiki Kaisha, Nagoya, Japan

[21] Appl. No.: 577,532

[22] Filed: Dec. 22, 1995

[30] Foreign Application Priority Data

Feb. 3, 1995 [JP] Japan ..... 7-016967

[51] Int. Cl.[6] ..... G03G 15/08

[52] U.S. Cl. ..... 399/284; 399/285

[58] Field of Search ..... 355/245, 246, 355/253, 259, 251; 118/651, 653, 657, 658, 661; 399/252, 260, 264, 272, 273, 274, 281, 283, 284, 285

[56] References Cited

U.S. PATENT DOCUMENTS

| | | | |
|---|---|---|---|
| Re. 34,724 | 9/1994 | Hosono et al. | 118/657 |
| 4,194,830 | 3/1980 | Ohnuma et al. | 118/661 X |
| 4,701,043 | 10/1987 | Takayama | 118/657 X |
| 4,851,873 | 7/1989 | Sakao et al. | 355/245 |
| 4,860,053 | 8/1989 | Yamamoto et al. | 355/245 |
| 5,097,294 | 3/1992 | Nishio et al. | 355/245 |
| 5,132,734 | 7/1992 | Momiyama et al. | 355/253 |

FOREIGN PATENT DOCUMENTS

| | | |
|---|---|---|
| 0 666 517A2 | 8/1995 | European Pat. Off. . |
| 41-9475 | 5/1941 | Japan . |

*Primary Examiner*—Shuk Lee

*Attorney, Agent, or Firm*—Oliff & Berridge, P.L.C.

[57] ABSTRACT

A developing device for use with an image forming apparatus that is capable of reliably preventing the entry of large particles of developing agent between a layer thickness limiting member and a developing agent carrier. The developing device includes an image carrier and a developing agent carrier that conveys a developing agent to the vicinity of the image carrier. The developing agent is conveyed to the vicinity of the image carrier. A layer thickness limiting member limits a thickness of a layer of the developing agent. The layer thickness limiting member includes a columnar member having a ridge line closely parallel to the surface of the developing agent carrier. The ridge line limits the thickness of the developing agent layer.

21 Claims, 2 Drawing Sheets

DEVELOPING DEVICE FOR IMAGE FORMING APPARATUS HAVING A LAYER THICKNESS LIMITING MEMBER

BACKGROUND OF THE INVENTION

1. Field of the Invention

This invention relates to a developing device for use in an image forming apparatus (such as, for example, a laser printer, a copier machine and a facsimile machine) that causes an electrically charged developing agent to adhere to an electrostatic latent image formed on an image carrier.

2. Discussion of Related Art

A related developing device includes an image carrier. An electrostatic latent image is formed on a surface of the image carrier. A developing agent carrier conveys a developing agent that adheres to the surface thereof to the vicinity of the image carrier. A layer thickness limiting member limits the thickness of a layer of the developing agent conveyed to the vicinity of the image carrier.

In an image forming apparatus (such as, for example, a laser printer, a copier or a facsimile), an electrostatic latent image corresponding to an image to be formed on recording paper is formed on an image carrier (such as a photosensitive drum). A developing agent, such as toner, is conveyed to the vicinity of the photosensitive drum from a toner tank via various types of developing agent carriers (such as, for example, rollers). The toner is electrically charged by friction while being conveyed to the vicinity of the photosensitive drum by the rollers. The toner conveyed to the vicinity of the photosensitive drum adheres to the electrostatic latent image. The image can be formed on the recording paper by transferring the charged toner adhering to the latent image onto the recording paper using a discharger or the like.

In image forming apparatus of this type, there is a demand that an interval between the surface of the roller that conveys toner and the surface of the photosensitive drum be as small as possible. When the interval between the toner conveying roller and the photosensitive drum is too large, toner splashes out to undesired areas on the photosensitive drum. Furthermore, the splashed toner is transferred to undesired areas on the recording paper. This produces so-called fog, which reduces image quality. To make the thickness of a toner layer formed on the surface of the roller as evenly small as possible, various propositions have been proposed.

In U.S. Reissued Pat. No. 34,724, for example, one surface of an elastic plate is brought into pressed contact with a roller. Toner is conveyed between the elastic plate and the roller. As a result of sandwiching the toner between the elastic plate and the roller, the thickness of the toner layer is made uniform to a certain extent. Toner, however, has variations in particle size. When toner particles having a large size enter the gap between the elastic plate and the roller, the elastic plate deflects in response to the larger toner particles. The gap between the elastic plate and the roller around the area where the toner enters the gap may become large. Thus, the partially enlarged gap makes it impossible to produce a sufficiently uniform thickness of the toner layer formed on the surface of the roller. Additionally, when large sized toner particles pass through the gap between the elastic plate and the roller, an image having a poor quality may be formed on the recording paper.

SUMMARY OF THE INVENTION

An object of the present invention is to overcome the above problems by providing a developing device capable of reliably preventing the entry of a developing agent having a large particle size between a layer thickness limiting member and a developing agent carrier.

This and other objects are achieved by providing a developing device including an image carrier having a surface on which an electrostatic latent image is formed. A developing agent carrier conveys a developing agent to the vicinity of the image carrier. The developing agent adheres to a surface of the developing agent carrier. The developing agent is conveyed to the vicinity of the image carrier while adhering to the surface of the developing agent carrier. A layer thickness limiting member limits the thickness of a layer of the developing agent. The layer thickness limiting member includes a columnar member having a ridge line disposed closely parallel to the surface of the developing agent carrier. The ridge line limits the thickness of the developing agent layer.

The columnar member preferably may include a free end having a ridge line and a fixed end provided downstream in a conveying direction of the developing agent with respect to the free end. Furthermore, the columnar member may be disposed in such a manner as to face the surface of the developing agent carrier with one ridge line.

With this arrangement, the developing agent adheres to the surface of the developing agent carrier, and the developing agent carrier conveys the developing agent to the vicinity of the image carrier. The layer thickness limiting member limits the thickness of the developing agent layer that is conveyed to the vicinity of the image carrier on the surface of the developing agent carrier. The developing agent thus conveyed to the vicinity of the image carrier adheres to an electrostatic latent image formed on the image carrier.

The layer thickness limiting member includes the columnar member that has a ridge line closely parallel to the surface of the developing agent carrier. With this construction, the developing agent adhering to the developing agent carrier has a uniform thickness that corresponds to a gap between the ridge line and the surface of the developing agent carrier. Further, since the layer thickness limiting member is the columnar member, it is less likely to encounter shear deformation or bending when contacting larger toner particles. For this reason, the gap between the ridge line and the surface of the developing agent carrier is less apt to change. Therefore, it is difficult for large particles of developing agent to enter the gap.

Accordingly, the present invention can reliably prevent the entry of the developing agent having a large particle size between the layer thickness limiting member and the developing agent carrier. As a result, it is possible to make the thickness of the developing agent layer conveyed to the vicinity of the image carrier uniform and small. This produces a sharp image formed on the recording paper.

In one embodiment, the columnar member preferably includes a free end having the ridge line and a fixed end provided downstream in the conveying direction of the developing agent with respect to the free end. With this arrangement, when large particles of developing agent come into contact with the vicinity of the ridge line of the columnar member, the force applied by the large particles of developing agent to the columnar member acts in a direction substantially parallel to the axis of the columnar member. Hence, the columnar member is much less likely to encounter shear deformation or bending. As a result, it is possible to reliably prevent the entry of large particles of developing agent between the layer thickness limiting member and the developing agent carrier. This prevents large particles of developing agent from reaching the image carrier.

In another embodiment, the columnar member is preferably disposed to face the surface of the developing agent carrier with one ridge line between the columnar member and the surface of the developing agent carrier. With this arrangement, the columnar member faces the surface of the developing agent carrier with no surface interposed therebetween. As a result, it is possible to prevent the developing agent from being fused and attached to either the columnar member or the surface of the developing agent carrier when sandwiched therebetween. Therefore, it is possible to improve durability of the developing device.

BRIEF DESCRIPTION OF THE DRAWING

The invention will be described in conjunction with the following drawings in which like reference numerals designate like elements and wherein.

DESCRIPTION OF THE PREFERRED EMBODIMENTS

Figure 1:
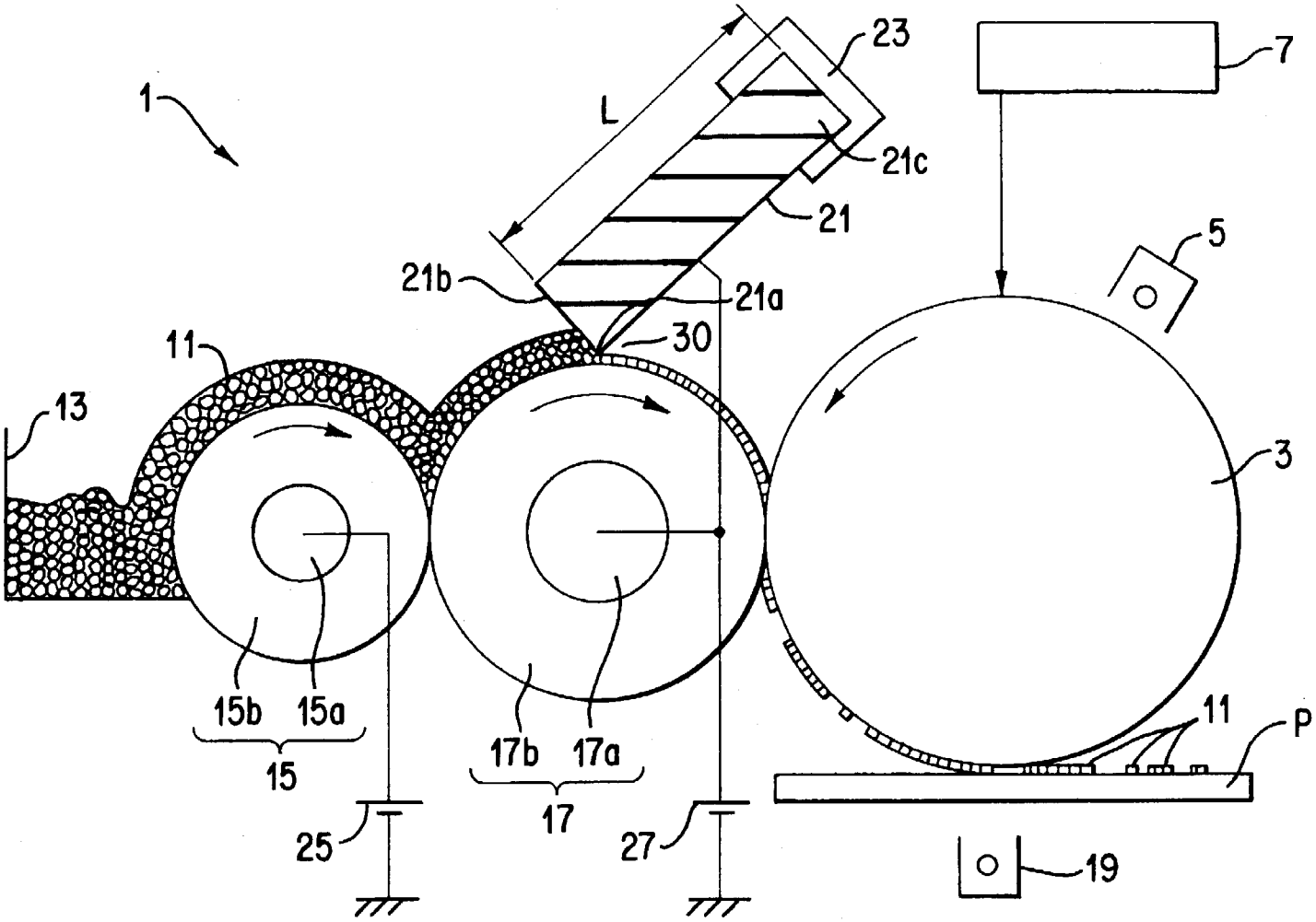
FIG. 1 is a schematic view depicting an image forming apparatus having a developing device according to the present invention.

FIG. 1 is a schematic view depicting an image forming device that uses a developing device in accordance with an embodiment of the present invention. The embodiment will be described using a laser printer 1 as an illustrative example. However, it is to be apparent to those of skill in the art that the developing device described herein can be used together with other laser printers (as disclosed, for example, in European Patent Publication No. 666 517 A2) and other image forming apparatus (such as, for example, copiers and facsimile machines).

The laser printer 1 includes a photosensitive drum 3 that acts as an image carrier, a corona discharger 5 that charges the surface of the photosensitive drum 3 to an even electric potential, and a scanner unit 7 that emits a laser beam to the photosensitive drum 3 based on image data input from the external source (i.e., a computer). The corona discharger 5 discharges the electric charges from the areas on the surface of the photosensitive drum 3 exposed to the laser beam.

The laser printer 1 further includes a toner tank 13 that stores the developing agent 11 (such as, for example, non-magnetic one-component toner). A feed roller 15 and a developing roller 17 serve as developing agent carriers to convey the toner 11 to the surface of the photosensitive drum 3. As will be described later, the toner 11 is electrified while being conveyed by the rollers 15 and 17 and then adheres to the electrostatic latent image formed on the photosensitive drum 3. As a result, the electrostatic latent image is visualized.

The photosensitive drum 3 faces a corona discharger 19 for transferring the toner image downstream in the direction of rotation of the photosensitive drum 3 with respect to the position where the photosensitive drum 3 comes into contact with the developing roller 17. For this reason, when recording paper P, used as a recording medium, is conveyed between the photosensitive drum 3 and the corona discharger 19 by a conveying mechanism (not shown), the toner 11 adhering to the electrostatic latent image is transferred to the recording paper P by the action of an electric field generated by the corona discharger 19. So-called reversal processing is employed by a common laser printer, and therefore the toner 11 has the same polarity of electrification as that of the photosensitive drum 3.

The surface of the developing roller 17 is adjacent a columnar member 21. The columnar member 21 is a layer thickness limiting member that limits the thickness of a layer of the toner 11 conveyed by the developing roller 17 to the photosensitive drum. The columnar member 21 is molded from electrically conductive rubber (such as, for example, a hard rubber dispersed with carbon) into a rectangular parallelepiped having a ridge line 21*a*. A small gap 30, shown in FIG. 1, extends between the ridge line 21*a* and the surface of the developing roller 17 parallel to the longitudinal axis of the roller 17. The gap between the ridge line 21*a* and the roller 17 is, preferably, between 5 μm and 10 μm. An end surface 21*b*, including the ridge line 21*a* as one end thereof, is disposed as a free end of the columnar member 21. The end surface 21*b* is positioned upstream in the conveying direction of the toner 11. An opposite end surface 21*c* of the columnar member 21 is disposed downstream in the conveying direction of the toner 11 and is fixed to a housing (not shown) of the laser printer 1 by a fixing section 23.

The feed roller 15 includes a core 15*a* and a highly resistible sponge 15*b* wrapped around the core 15*a*. The developing roller 17 includes a core 17*a* and rubber 17*b* coiled around the core 17*a*. The rubber 17*b* is preferably formed of materials of the frictional electrification series (such as, for example, silicon and urethane) that negatively charge the toner 11. Positive charges (being opposite in polarity to the toner 11) are applied from d.c. power supplies 25 and 27 to the cores 15*a* and 17*a*, respectively, such that the core 17*a* has a higher electric potential than the core 15*a*. The positive charges cause the toner 11 to adhere to the rollers 15 and 17. The d.c. power supply 27 also applies the same electric charge to the columnar member 21 as applied to the core 17*a*. Further, the feed roller 15 and the developing roller 17 rotate in a direction opposite to the rotation of the photosensitive drum 3 (as indicated by the arrows in FIG. 1).

The operation of the laser printer 1 having the above construction will now be described. The cores 15*a* and 17*a* of the feed roller 15 and the developing roller 17 are held in high electric potentials whereby the core 17*a* has a higher electric potential than the core 15*a* such that toner 11 is conveyed from the feed roller 15 to the developing roller 17. The toner 11 stored in the toner tank 13 is reliably conveyed to the surface of the photosensitive drum 3 by the rollers 15 and 17. The surfaces of the rollers 15 and 17 move in different directions where the feed roller 15 contacts the developing roller 17. As a result, the toner sandwiched between the rollers is frictionally electrified. Subsequently, the toner 11 is sandwiched between the columnar member 21 and the developing roller 17, such that the toner is further frictionally electrified.

The ridge line 21*a* of the columnar member 21 is parallel to the surface of the developing roller 17. The elasticity of the columnar member 21 brings the columnar member 21 adjacent the surface of the developing roller 17 such that a small gap exists between the ridge line 21*a* and the roller 17. As a result, the thickness of the toner 11 passing through this area is made uniform. Furthermore, the ridge line 21*a* prevents toner particles having a size greater that the gap from passing through the gap. For example, toner particles having a size greater than 10 μm are blocked by the ridge line 21*a*. Moreover, since the columnar member 21 is formed into a rectangular parallelepiped, it is less likely to encounter shear deformation or bending as compared to a plate like member in the presence of large particles of toner. Therefore, it is possible to reliably prevent the passage of large particles of toner 11 between the columnar member 21 and the developing roller 17.

The end surface 21*c* of the columnar member 21 is disposed downstream in the conveying direction of the toner 11 and is fixed. The force applied by large particles of toner 11 acts in a direction substantially along the axis of the columnar member 21. For this reason, the columnar member 21 is further less likely to encounter shear deformation or bending, and can reliably prevent any large particles of toner 11 from passing between the columnar member 21 and the developing roller 17. Accordingly, the layer of the toner 11 conveyed to the vicinity of the photosensitive drum 3 is made uniform. As a result, it is possible to form an extremely sharp image on the recording paper P.

The large size particles of toner 11 contact other toner particles adjacent the end surface 21*c* and the ridge line 21*a*. As a result, the large size toner particles can be broken down into smaller toner particles that may be conveyed past the ridge line 21*a* of the columnar member 21 to the photosensitive drum 3.

The columnar member 21 faces the developing roller 17 with one ridge line 21*a* interposed therebetween. The columnar member 21 and the developing roller 17 never face each other with a surface interposed therebetween. Therefore, it is possible to prevent the toner 11 from being sandwiched between the columnar member 21 and the developing roller 17. This prevents toner from being fused to either the columnar member 21 or the developing roller 17. Accordingly, it is also possible to improve the durability of the columnar member 21 and the developing roller 17. The core 17*a* and the columnar member 21 are maintained at the same electric potential. As a result, the electrified toner 11 is fused to neither the core 17*a* nor the columnar member 21, and the toner 11 is reliably conveyed to the surface of the photosensitive drum 3. This greatly increases the ability to produce a uniform thickness of toner 11.

The present invention is not limited to the above embodiment. Conceivable variations of the present invention fall within the scope of the present invention. For example, the developing agent carrier is not limited to the rollers 15 and 17. The developing agent carrier may include a belt, as disclosed in Japanese Patent Publication No. Sho 41-9475.

Moreover, in addition to the conductive rubber described above, the columnar member 21 may be formed of an insulating rubber, a dielectric rubber or a resin. It is still possible to form an even toner layer of the toner 11 and prevent the toner 11 from adhering to the columnar member. To prevent shear deformation or bending of the columnar member 21, it is desirable to form the columnar member 21 from isotropic elastic materials (such as, for example, rubber and a resin). Additionally, the height H of the columnar member 21 should not be negligible with respect to a length L of the same. It is desirable that a ratio of the height H to the length L of the columnar member 21 should be $H/L > 1/10$.

Figure 2A:
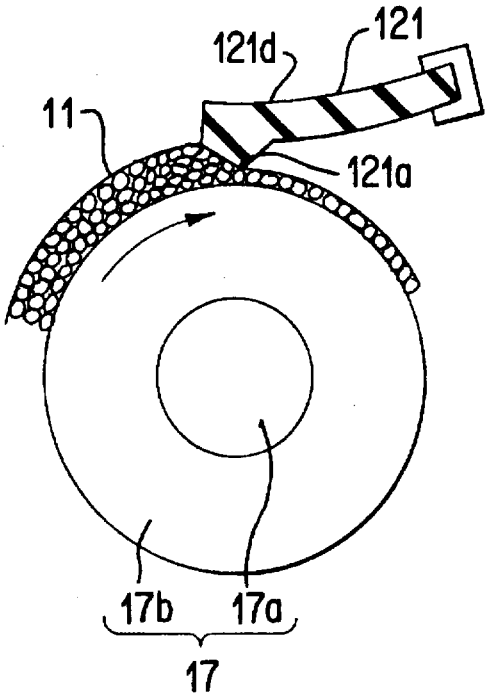
FIG. 2A is a schematic view depicting a columnar member according to another embodiment of the present invention.
Figure 2B:
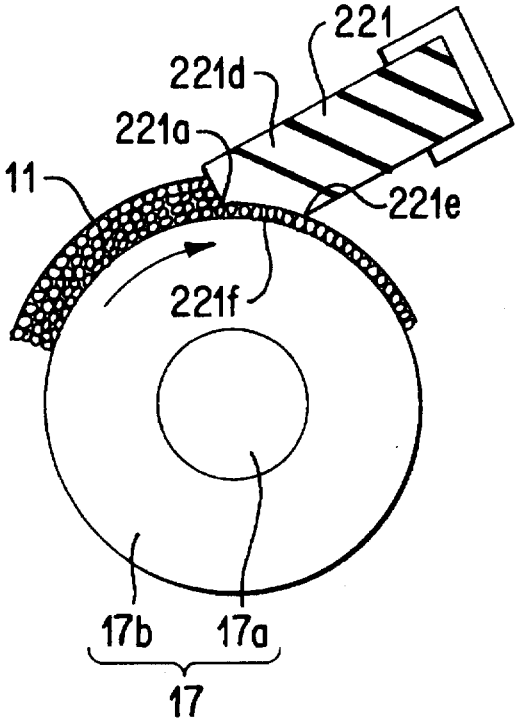
FIG. 2B is a schematic view depicting a columnar member according to another embodiment of the present invention.

Various types of rectangular parallelepipeds may be used to form the columnar member 21. FIGS. 2A and 2B illustrate additional embodiments of the present invention. In FIG. 2A, a columnar member 121 has a free end 121*d* with a ridge line 121*a*. A small gap exists between the ridge line 121*a* and the roller 17. The gap is, preferably, between 5 μm and 10 μm. The free end 121*d* has a larger cross section than the other portions thereof. Even in this case, as in the previous embodiment, it is possible to prevent the large particles of toner 11 from entering between the columnar member 121 and the surface of the developing roller 17. This forms an even layer of the toner 11 and prevents the fusing of the toner 11 to the columnar member 121 and the developing roller 17. In this embodiment, the amount of material used to form the columnar member 121 is reduced.

In FIG. 2B, a columnar member 221 has a free end 221*d* with a ridge line 221*a* and another ridge line 221*e*. This free end 221*d* has a surface 221*f* defined between the ridge lines 221*a* and 221*e*, and the surface 221*f* faces the developing roller 17. A small gap exists between the surface 221*f* and the roller 17. The gap is, preferably, between 5 μm and 10 μm. Even in such a case, as in the previous embodiments, it is possible to form an even layer of the toner 11 because the ridge line 221*a* prevents entry of large particles of toner 11.

As discussed above, a contact d.c. biasing method is used as the developing method, wherein a d.c. voltage is applied as a developing bias to the photosensitive drum 3 and the developing roller 17 while they are in contact with each other. However, other developing methods including, for example, an a.c. voltage applied to the rollers and drum are also applicable with the present invention.

While this invention has been described in conjunction with specific embodiments thereof, it is evident that many alternatives, modifications and variations will be apparent to those skilled in the art. Accordingly, the preferred embodiments of the invention as set forth herein are intended to be illustrative not limiting. Various changes may be made without departing from the spirit and scope of the invention as defined by the following claims.

What is claimed is:

1. A developing device comprising:

an image carrier having a surface on which an electrostatic latent image is formed;

a developing agent carrier positioned adjacent said image carrier that conveys a developing agent to said image carrier; and a layer thickness limiting member positioned adjacent said image carrier that limits a thickness of a layer of the developing agent conveyed to said image carrier and prevents particles larger than said thickness of said layer of the developing agent from being conveyed to said image carrier by sandwiching said developing agent between said layer thickness limiting member and said developing agent carrier, wherein said developing agent is frictionally electrified while the developing agent is sandwiched between the layer thickness limiting member and the developing agent carrier and said layer thickness limiting member includes a columnar member having a ridge line disposed closely parallel to a carrier surface of said developing agent carrier, said ridge line limiting the thickness of the developing agent layer.

2. The developing device according to claim 1, wherein the developing agent adheres to said at least one carrier surface as the developing agent is conveyed to said surface of said image carrier.

3. The developing device according to claim 1, further comprising a gap positioned between said ridge line and said carrier surface, wherein said gap is approximately between 5 μm and 10 μm.

4. The developing device according to claim 1, wherein said columnar member is oriented with respect to said carrier surface of said developing agent carrier with one ridge line .positioned between said columnar member and said carrier surface of said developing agent carrier.

5. The developing device according to claim 1, wherein said columnar member having a height H and a length L, and a height to length ratio H/L>0.1.

6. The developing device according to claim 1, wherein said columnar member has a free end portion having an end surface that includes said ridge line positioned on one edge of said end surface and a fixed end portion.

7. The developing device according to claim 6, wherein said columnar member has a length that extends substantially perpendicular to said end surface, and a force applied by large sized particles of developing agent on end surface of said columnar member are directed along said columnar member in a direction substantially parallel to said length.

8. The developing device according to claim 6, wherein said fixed end portion is mounted to a developing device fixing section.

9. The developing device according to claim 6, wherein said developing agent carrier conveys developing agent to said surface of said image carrier in a conveying direction, and said fixed end portion of said columnar member being positioned downstream of said free end portion of said columnar member with respect to the conveying direction.

10. The developing device according to claim 6, wherein said developing agent carrier conveys developing agent to said surface of said image carrier in a conveying direction, said columnar member further including a second ridge line positioned downstream of said ridge line with respect to the conveying direction.

11. The developing device according to claim 10, wherein said columnar member is oriented with respect to said carrier surface of said developing agent carrier with said ridge line and said second ridge line being positioned between said columnar member and said carrier surface of said developing agent carrier.

12. The developing device according to claim 10, wherein said columnar member has a length that extends substantially perpendicular to said end surface, and a force applied by large sized particles of developing agent on said end surface of said columnar member are directed along said columnar member in a direction substantially parallel to said length.

13. The developing device according to claim 1, wherein said columnar member is formed of an isotropic elastic material.

14. The developing device according to claim 1, wherein a power supply is provided, and said power supply applies a first electric charge to said developing agent carrier, and applies a second electric charge to said layer thickness limiting member, said first and second electric charges having the same polarity.

15. A developing device comprising:

an image carrier having a surface on which an electrostatic latent image is formed;

a developing agent carrier positioned adjacent said image carrier having a carrier surface that conveys a developing agent to said image carrier; and a layer thickness limiting member positioned adjacent said image carrier having a columnar member having at least one ridge line disposed closely parallel to said carrier surface of said developing agent carrier, said at least one ridge line limiting the thickness of a layer of developing agent conveyed to said image carrier by sandwiching said developing agent between said layer thickness limiting member and said developing agent carrier, said developing agent being frictionally electrified while the developing agent is sandwiched between the layer thickness limiting member and the developing agent carrier, and said layer thickness limiting member being oriented with respect to said carrier surface of said developing agent carrier to prevent particles larger than said thickness of said layer of the developing agent from being conveyed to said image carrier.

16. The developing device according to claim 15, wherein said columnar member is oriented with respect to said carrier surface of said developing agent carrier with a single ridge line positioned between said columnar member and said carrier surface of said developing agent carrier.

17. The developing device according to claim 16, wherein said columnar member has a free end portion having an end surface that includes said single ridge line positioned on one edge of said end surface.

18. The developing device according to claim 17, wherein said columnar member has a length that extends substantially perpendicular to said end surface, and a force applied by large sized particles of developing agent on said end surface of said columnar member are directed along said columnar member in a direction substantially parallel to said length.

19. The developing device according to claim 15, wherein said developing agent carrier conveys developing agent to said surface of said image carrier in a conveying direction, said at least one ridge line including first and second ridge lines, said second ridge line being positioned downstream of said first ridge line with respect to the conveying direction.

20. The developing device according to claim 19, wherein said columnar member is oriented with respect to said carrier surface of said developing agent carrier with said first ridge line and said second ridge line being positioned between said columnar member and said carrier surface of said developing agent carrier.

21. The developing device according to claim 15, wherein a power supply is provided, and said power supply applies a first electric charge to said developing agent carrier, and applies a second electric charge to said layer thickness limiting member, said first and second electric charges having the same polarity.

* * * * *